United States Patent [19]

Fernandez Aldape

[11] 4,235,022

[45] Nov. 25, 1980

[54] DEVICE FOR LINEAR DRAWING

[76] Inventor: Jose M. Fernandez Aldape, Doctor Areilza, 55-40 A, Bilbao, Spain

[21] Appl. No.: 10,676

[22] Filed: Feb. 6, 1979

[30] Foreign Application Priority Data

Feb. 23, 1978 [ES] Spain ..... 234.191[U]

[51] Int. Cl.[3] ..... B43L 13/00

[52] U.S. Cl. ..... 33/474; 33/42

[58] Field of Search ..... 33/477, 41 B, 42 R, 33/27 C, 474

[56] References Cited

U.S. PATENT DOCUMENTS

| | | | |
|---|---|---|---|
| 844,243 | 2/1907 | Breul | 33/42 |
| 1,692,149 | 11/1928 | Castan | 33/477 |
| 1,993,347 | 3/1935 | McMillan | 33/474 |

*Primary Examiner*—John W. Shepperd

*Attorney, Agent, or Firm*—Wenderoth, Lind & Ponack

[57] ABSTRACT

A device for drawing parallel lines both in vertical and horizontal directions, and for drawing circumferences without a compass, includes two pieces, one of which is a set square and the other of which is a plate. Two adjacent edges of the plate are provided with markings, such as a millimetric scale, and groups of holes are distributed in relation to the markings of the indicated scale.

5 Claims, 3 Drawing Figures

DEVICE FOR LINEAR DRAWING

Figure 1:
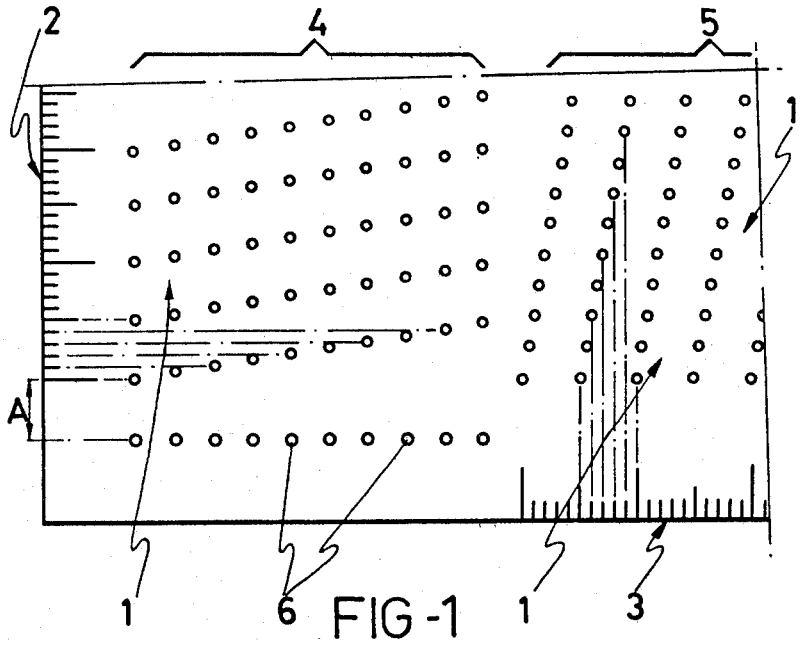

The present invention relates to a device for linear drawing, the purpose of which is to proportion means which permit the drawing, particularly, of parallel straight lines both in a vertical and a horizontal direction, or even a combination of lines in both directions.

Furthermore the device of this invention can also be used to draw circumferences without a compass.

The device comprises two pieces having a combined function. One of such pieces consists in a simple set square, the legs of which have an indefinite length.

The other piece consists in a plate, rectangular or square, at least two of the adjacent sides of which are marked with, for example, millimeters or any other measurement.

Furthermore, and as a very important characteristic, said plate has two groups of holes arranged in rows which are oblique and parallel in each group.

Such holes are so arranged that between anyone of them and those immediately anterior or posterior of the same row there is a constant distance which, on being projected towards one of the marked edges of the plate, is, for example, equivalent to 1 mm.

The rows of holes of one of the groups are slightly inclined with respect to the vertical.

The rows of holes of the other group are slightly inclined with respect to the horizontal.

The purpose of anyone of the holes is to enable the point of a pencil to be introduced, so that it rests on the paper on which the drawing should be made and then the plate will be moved along the corresponding side of the set square. Thus, the drawing of a vertical or horizontal line will be obtained, depending on the group to which the hole, into which the pencil has been introduced, corresponds.

The point of the pencil is then introduced into the following hole and the plate is again moved, thus obtaining the drawing of another line parallel to the former.

Besides, there is an auxiliary group of holes which will act as possible centres for the drawing of other possible circumferences, the holes of the previously mentioned group acting as guiding lines.

The description of the characteristics which has briefly been mentioned, as well as the functioning of the object of the invention, will be enlarged with the help of the accompanying drawings, wherein the following is illustrated:

FIG. 1 - a plan view partially representing the plate provided with groups of holes.

Figure 2:
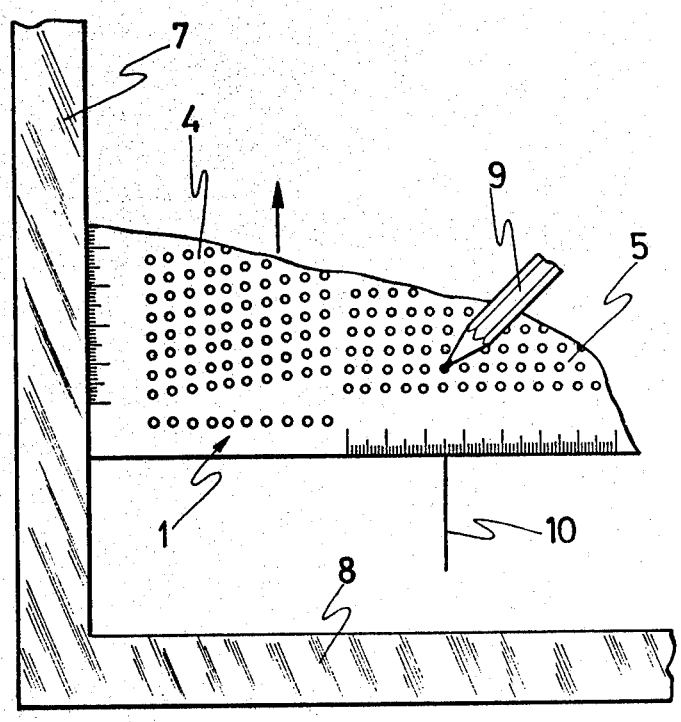

FIG. 2 - a plan view of the assembly of the device, partially representing the two pieces constituting same, the set square and the plate, in a working position to draw parallel vertical lines.

Figure 3:
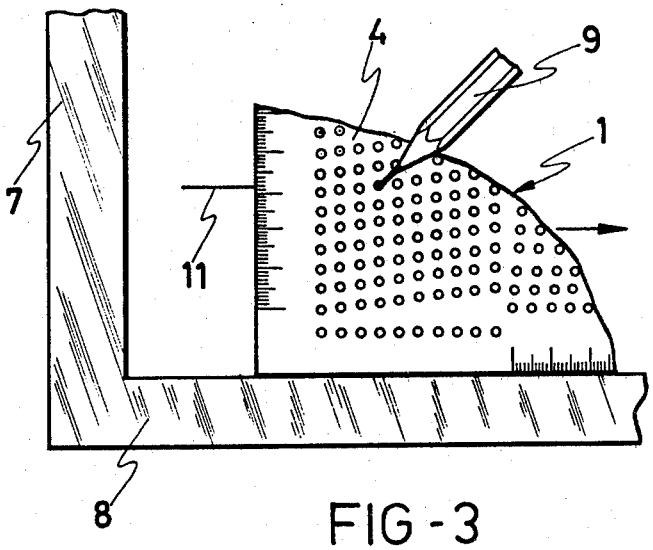

FIG. 3 - a view similar to that of FIG. 2 with the device in a working position to draw parallel horizontal lines.

Reverting to FIG. 1, a plate 1 for example, rectangular, preferably made from transparent plastic material, is generically represented.

Two of the adjacent edges of said plate 1 are provided with markings 2 and 3, respectively, which can correspond to the millimetric scale.

Plate 1 has two groups of holes, generically referenced 4 and 5.

The group of holes 4 is composed of rows of holes which are parallel to one another, one row being equally spaced from the other.

It can be seen that said rows of holes of group 4 form a certain angle with respect to the horizontal.

The deviation in an oblique direction presented by each one of the holes composing anyone of the rows, with respect to the adjacent hole of the row itself, corresponds to the horizontal projection of the millimetric scale 2.

This feature is applicable to the rows of holes of group 5, with the difference that the oblique deviation corresponds to the vertical projection of the millimetric scale 3.

The hole which initiates the first row of holes of group 4 coincides with the initial marking of the millimetric scale 2.

The group of holes 5, the first of which also forms the lower row, coincides with the initial marking of the scale 3.

Besides, there is a row of holes 6 which will be the points of the possible centres of circumferences which can be drawn with this device, without using a compass. The way in which circumferences are drawn will be explained subsequently.

Reverting to FIG. 2, it can be seen that the plate 1 is supported on the leg 7 of the set square, so that by introducing, for example, the point of a pencil 9 into anyone of the holes of group 5 and then turning the plate 1, as indicated by the arrow in said FIG. 2, said plate not loosing contact with the leg 7 of the set square, a vertical line 10 would have been drawn.

Then, placing the plate 1 at the starting point and introducing the point of a pencil 9 into the next hole of the row and moving plate 1, a line parallel to that already drawn 10 will be obtained.

To draw parallel lines in a horizontal direction, it is sufficient to contemplate FIG. 3. Thus, the holes of group 4 will now be used to introduce the point of the pencil 9 while the plate 1, resting permanently on the leg 8 of the set square, will be moved in the direction of the arrow, drawing lines such as those referenced 11.

To draw circumferences, any object, for example a prong, is introduced in anyone of the holes 6, while the point of the pencil will be introduced into anyone of the holes of group 4. The plate 1 will then be turned on the paper, without the help of the set square, thus obtaining the drawing of the circumference.

It should be taken into account that a given radius, for drawing circumferences, will be the distance in millimeters which corresponds to the site occupied by the hole of the group 4 chosen to introduce the point of the pencil, to which the constant distance A from the line of the holes of centres 6 should be added.

I claim:

1. A drawing device which is used for linear drawing comprising:

a rectangular plate having first and second straight edges which are perpendicular to each other, each having a scale thereon;

a first group of holes arranged in a first plurality of parallel lines which are disposed oblique to said respective first edge of said plate, each of said holes corresponding to a measurement marking on said scale of said first edge;

a second group of holes arranged in a second plurality of parallel lines which are disposed oblique to said respective second edge of said plate, each of said holes corresponding to a measurement marking on said scale of said second edge;

a row of holes located so as to define a straight line which is parallel to said second edge, said holes of said row being aligned with aligned holes of said first group of said holes so as to define lines which are parallel to said first edge and cross said obliquely disposed first plurality of parallel lines, each of said holes of said row comprising means for defining the center of a radius of a circumferential line to be drawn by inserting holding means into a respective said hole of said row and inserting marking means in which said respective hole of said row into a hole of the respective said line is included and which is parallel to said first edge, so that said plate may be rotated by said marking means about said holding means in said radius defining hole for drawing a circumferential line having a specified radius; and an L-shaped set square for use in combination with said plate, wherein said oblique angle extending lines of holes can be used for drawing both laterally extending and respective orthogonally extending parallel lines, by respectively sliding said plate, with a marking means respectively inserted in a respective one hole of one of the holes of said oblique lines of holes, along and in contact with the corresponding edge of said set square.

2. A drawing device as claimed in claim 1, wherein said first and second measurement scales comprise millimeter scales.

3. A drawing device as claimed in claim 2, wherein each hole in said oblique lines of holes is located to correspond in projection to a one millimeter unit on the respective said scale.

4. A drawing device as claimed in claim 1, wherein the sides of said rectangular plate have equal lengths.

5. A drawing device as claimed in claim 1, wherein two parallel sides of said rectangular plate have a greater length than the other two parallel sides.

* * * * *